US009961937B2

(12) United States Patent
Liu

(10) Patent No.: US 9,961,937 B2
(45) Date of Patent: May 8, 2018

(54) ELECTRONIC CIGARETTE AND ASSEMBLY METHOD THEREFOR

(71) Applicant: HUIZHOU KIMREE TECHNOLOGY CO., LTD. SHENZHEN BRANCH, Shenzhen (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 0 days. days.

(21) Appl. No.: 15/304,548

(22) PCT Filed: Apr. 16, 2014

(86) PCT No.: PCT/CN2014/075490

§ 371 (c)(1),
(2) Date: Oct. 17, 2016

(87) PCT Pub. No.: WO2015/157938

PCT Pub. Date: Oct. 22, 2015

(65) Prior Publication Data

US 2017/0042225 A1 Feb. 16, 2017

(51) Int. Cl.
*A24F 47/00* (2006.01)

(52) U.S. Cl.
CPC ..... *A24F 47/004* (2013.01); *A24F 47/008* (2013.01)

(58) Field of Classification Search
CPC .. A24C 5/18; A24C 5/52; A24C 5/477; A24F 13/02; A24F 1/00
See application file for complete search history.

(56) References Cited

U.S. PATENT DOCUMENTS 2,597,124 A * 5/1952 Nohr ..... A24F 1/00 131/194
2,954,772 A * 10/1960 Lebert ..... A24F 13/04 131/187

(Continued)

FOREIGN PATENT DOCUMENTS

CN 103300481 A 9/2013
CN 203492784 U 3/2014

OTHER PUBLICATIONS

International Search Report of PCT Patent Application No. PCT/CN2014/075490 dated Jan. 19, 2015.

*Primary Examiner* — Truc Nguyen

(57) ABSTRACT

The invention is related to an electronic cigarette and an assembly method therefor. The electronic cigarette comprises an electronic cigarette body and a mouthpiece device connected at one end of the electronic cigarette body. The electronic cigarette body is provided with at least one first smoke channel. The mouthpiece device is provided with a second smoke channel. The mouthpiece device is in a sliding butting connection with the electronic cigarette body. The junction between the mouthpiece device and the electronic cigarette body is provided with an elastic assembly. The elastic assembly is used to enable the first smoke channel and the second smoke channel to be in communication with one another or to be staggered from one another and not in communication. The beneficial effects of the electronic cigarette are that a child may be prevented from smoking the electronic cigarette by accident, and assembly is easy.

16 Claims, 10 Drawing Sheets

(56) References Cited

U.S. PATENT DOCUMENTS

| | | | | |
|---|---|---|---|---|
| 2015/0216236 | A1* | 8/2015 | Bless | A24F 47/008 131/328 |
| 2015/0272211 | A1* | 10/2015 | Chung | A24F 15/00 206/242 |
| 2015/0282524 | A1* | 10/2015 | Elhalwani | A24F 1/30 131/329 |
| 2016/0128386 | A1* | 5/2016 | Chen | A24F 47/008 131/329 |
| 2016/0270446 | A1* | 9/2016 | Shenkal | A24F 47/008 |
| 2016/0286865 | A1* | 10/2016 | King | A24F 47/008 |
| 2017/0196272 | A1* | 7/2017 | Li | A24F 47/002 |

* cited by examiner

ELECTRONIC CIGARETTE AND ASSEMBLY METHOD THEREFOR

FIELD OF THE INVENTION

The present application relates to the field of electronic heating products, and more particularly relates to an electronic cigarette and assembly method thereof.

BACKGROUND OF THE INVENTION

An electronic cigarette in prior art comprises a mouthpiece assembly and an electronic cigarette body. A smoke channel for smoke flowing is arranged in the electronic cigarette body, the smoke channel is in communication with the mouthpiece assembly, in order to form an air path when smoking.

However, only one check valve is arranged in the electronic cigarette in the prior art to control the opening or closing of the air flow path. The electronic cigarette of this structure has defects: the smoking operation is too simple, the air flow sensor triggers the work of the atomizing assembly to realize the atomization of the tobacco tar immediately after sensing the air flow, it is easy to atomize of the tobacco tar by mistake and waste the tobacco tar, and also easy to cause the children mistake inhalation, which affects the health of children.

The electronic cigarette in the prior art is lack of effective means to prevent the mistake inhalation, so it needs to be improved.

SUMMARY OF THE INVENTION

The present application is to provide an electronic cigarette and an assembly method of the electronic cigarette which can prevent the atomization of the tobacco tar by mistake and the children mistake inhalation.

The technical solutions of the present application for solving the technical problems are as follows:

Providing an electronic cigarette, which comprises an electronic cigarette body and a mouthpiece device connected at one end of the electronic cigarette body. The electronic cigarette body is provided with at least one first smoke channel. The mouthpiece device is provided with a second smoke channel used to discharge smoke of the first smoke channel. The mouthpiece device is in a sliding butting connection with the electronic cigarette body. The junction between the mouthpiece device and the electronic cigarette body is provided with an elastic assembly. The elastic assembly is used to provide an elastic force to the mouthpiece device for being away from the electronic cigarette body when in a stretched state, and to limit the position of the mouthpiece device when in a non-stretched state, so as to enable the first smoke channel and the second smoke channel to be in communication with one another or to be staggered from one another and not in communication.

Wherein the electronic cigarette of present invention, the elastic assembly comprises a first elastic assembly and a second elastic assembly; the first elastic assembly is between the electronic cigarette body and the mouthpiece device, and the first elastic assembly provides the elastic force to the electronic cigarette body and the mouthpiece device respectively; one end of the second elastic assembly is connected permanently with the electronic cigarette body, a limit convex which buckles the mouthpiece device when in a non-stretched state is arranged on the other end of the second elastic assembly.

Wherein the electronic cigarette of present invention, the mouthpiece device comprises a mouthpiece tube, and a moving part detachably connected with one end of the mouthpiece tube; the limit convex buckles the moving part when in a non-stretched state.

Wherein the electronic cigarette of present invention, the second smoke channel is arranged along the moving part axially and in communication with the mouthpiece tube.

Wherein the electronic cigarette of present invention, a first slope fitting for the limit convex is arranged on the lateral edge of the end of the moving part, and the end is opposite to the electronic cigarette body; a second slope which adapts with the first slope is arranged on the bottom end near the electronic cigarette body of the limit convex, a third slope is arranged on the end opposite to the electronic cigarette body of the limit convex.

Wherein the electronic cigarette of present invention, the elastic assembly comprises a first sealing element connected permanently with the electronic cigarette body, and a sealing plug configured for enabling the first smoke channel and the second smoke channel to be in communication with one another or to be staggered from one another and not in communication when in a non-stretched state.

Wherein the electronic cigarette of present invention, at least one through hole in communication with each the first smoke channel is arranged on the first sealing element; the first elastic assembly abuts elastically between the first sealing element and the moving part, an end of the second elastic assembly is arranged out the first sealing element.

Wherein the electronic cigarette of present invention, the sealing plug is connected permanently with the moving part, and extending towards the side near the electronic cigarette body, the sealing plug is configured for plug-in connecting with the first smoke channel when in a non-stretched state.

Wherein the electronic cigarette of present invention, the sealing plug is connected permanently with the first sealing element, and extending towards the side opposite to the electronic cigarette body, the sealing plug is configured for plug-in connecting with the second smoke channel in a non-stretched state.

Wherein the electronic cigarette of present invention, the first elastic assembly is any one of spring leaves or spring structures.

Wherein the electronic cigarette of present invention, the second elastic assembly comprises a fixed part connected permanently with the electronic cigarette body, a connector that one end is connected with the fixed part and extending towards the side opposite to the electronic cigarette body, and the limit convex connected with the other end of the connector.

Wherein the electronic cigarette of present invention, the mouthpiece device further comprises a mounting base detachably connected with the electronic cigarette body, and a fixed cover fixed on the mounting base.

Wherein the electronic cigarette of present invention, the fixed cover comprises a guide part, one end of the guide part is fixed on the fixed cover, the other end extending towards the side opposite to the fixed cover; an accommodation space for the elastic deformation of the second elastic assembly is arranged on the guide part.

Wherein the electronic cigarette of present invention, a guide groove fitting for the guide part is arranged on the mounting base.

Wherein the electronic cigarette of present invention, an internal thread configured for detachably connecting with the electronic cigarette body is arranged in the mounting base.

The present invention further provides an electronic cigarette, which comprises an electronic cigarette body and a mouthpiece device connected at one end of the electronic cigarette body. The electronic cigarette body is provided with at least one first smoke channel. The mouthpiece device is provided with a second smoke channel used to discharge smoke of the first smoke channel. The mouthpiece device is in a sliding butting connection with the electronic cigarette body. The junction between the mouthpiece device and the electronic cigarette body is provided with an elastic assembly. The elastic assembly is used to provide an elastic force to the mouthpiece device for being away from the electronic cigarette body when in a stretched state, and to limit the position of the mouthpiece device when in a non-stretched state, so as to enable the first smoke channel and the second smoke channel to be in communication with one another or to be staggered from one another and not in communication;

the mouthpiece device comprises a mouthpiece tube, and a moving part detachably connected with one end of the mouthpiece tube;

the elastic assembly comprises a first elastic assembly, a second elastic assembly and a sealing plug; the first elastic assembly abuts elastically between the electronic cigarette body and the moving part, one end of the second elastic assembly is connected permanently with the electronic cigarette body, a limit convex which buckles the mouthpiece device when in a non-stretched state is arranged on the other end of the second elastic assembly; the sealing plug is connected permanently with the moving part, and extending towards the side near the electronic cigarette body, the sealing plug is configured for plug-in connecting with the first smoke channel when in a non-stretched state.

The present invention further provides an assembly method of electronic cigarette, wherein the method comprises following steps:

S1, providing a mounting base, fixing an elastic assembly in the mounting base;

S2, providing a mouthpiece tube, a moving part and a fixed cover, connecting the mouthpiece tube to the moving part permanently, defining the fixed cover out of the mouthpiece tube, and fixing the fixed cover on the mounting base;

S3, providing an electronic cigarette body, connecting the electronic cigarette body to an end of the mounting base.

The implementation of the present invention has the following beneficial effects: By setting an elastic assembly connected to the electronic cigarette body in the mouthpiece device in present invention, the elastic assembly is configured for provide an elastic force to the mouthpiece device for being away from the electronic cigarette body when in a stretched state and to limit the position of the mouthpiece device when in a non-stretched state, so as to enable the first smoke channel and the second smoke channel to be in communication with one another or to be staggered from one another and not in communication, to make the elastic assembly have the function of the switch, and provides an effective method of preventing atomization of tobacco tar by mistake and mistake inhalation, to achieve the aim of preventing children mistake inhalation, and the operation of the electronic cigarette in present invention is simple and convenient, selectivity is good, and assembly is easy.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENT

To make the technical feature, objective and effect of the present application be understood more clearly, now the specific implementation of the present application is described in detail with reference to the accompanying drawings and embodiments. Understandably, the specific implementation here is merely used to explain the present invention, but not used to limit the present invention.

Figure 1:
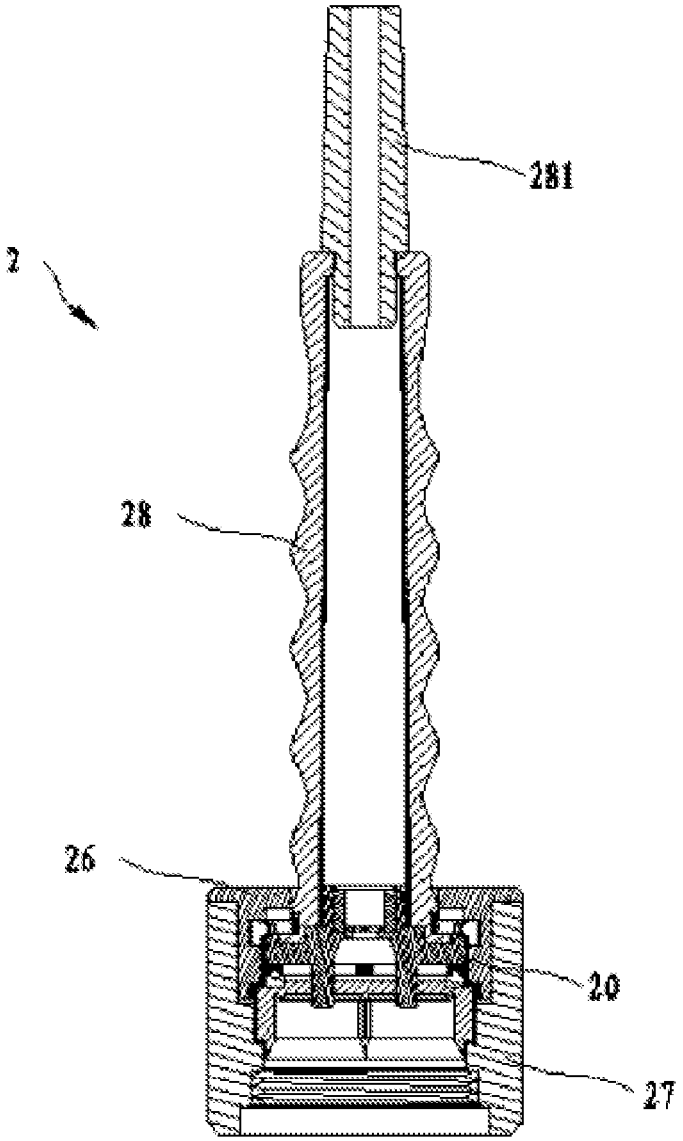
FIG. 1 is a structural schematic view of a mouthpiece device of an electronic cigarette in one of the preferable embodiments of the present application.
Figure 2:
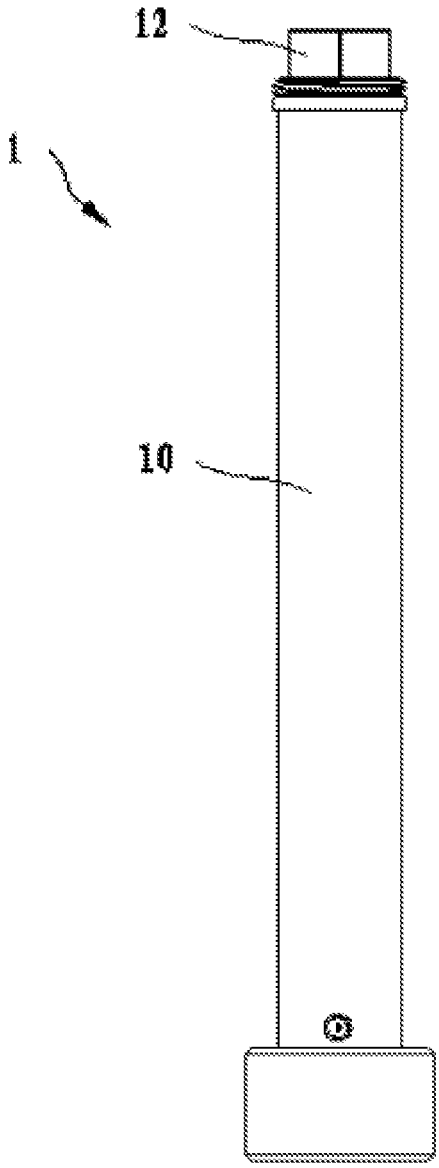
FIG. 2 is a structural schematic view of an electronic cigarette body of an electronic cigarette in one of the preferable embodiments of the present application.

As shown in FIG. 1 and FIG. 2, a structural schematic view of an electronic cigarette in a first embodiment provided by present application, the electronic cigarette comprises an electronic cigarette body 1 and a mouthpiece device 2 connected at one end of the electronic cigarette body 1, in present invention, the electronic cigarette body 1 is detachably connected with the mouthpiece device 2, understandably in other embodiments, the electronic cigarette body 1 and the mouthpiece device 2 can be integrally formed.

Further, the electronic cigarette body 1 is provided with at least one first smoke channel 11, the mouthpiece device 2 is provided with a second smoke channel 251 used to discharge smoke of the first smoke channel 11 (shown in FIG. 5), the mouthpiece device 2 is in a sliding butting connection with the electronic cigarette body 1, the junction between the mouthpiece device 2 and the electronic cigarette body 1 is provided with an elastic assembly 20, the elastic assembly 20 is used to provide an elastic force to the mouthpiece device 2 for being away from the electronic cigarette body 1 when in a stretched state, and to limit the position of the mouthpiece device 2 when in a non-stretched state, so as to enable the first smoke channel 11 and the second smoke channel 251 to be in communication with one another or to be staggered from one another and not in communication.

The electronic cigarette body 1 of the electronic cigarette is described in detail with the combination of the implementation shown in FIG. 2 as following.

FIG. 2 is a structural schematic view of an electronic cigarette body 1, the electronic cigarette body 1 comprises a hollow cylindrical external sleeve 10, an atomizing assembly 12 arranged in the external sleeve 10 for producing smoke and a battery assembly used for supplying power to the atomizing assembly 12 (not shown in the figure), a first smoke channel 11 is defined at one end of the atomizing assembly 12 (combining with the illustration of FIG. 4), the smoke produced by the atomizing assembly 12 flows into the mouthpiece device 2 through the first smoke channel, and is inhaled by user. As the structure and working principle of the atomizing assembly 12 and the battery assembly are based on the prior art, so it is not explained in detailed.

Figure 4:
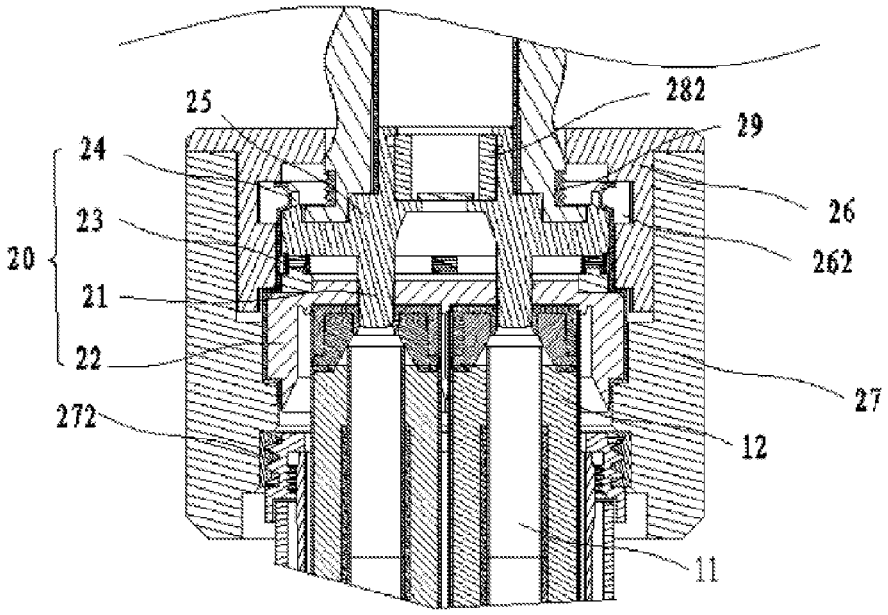
FIG. 4 is a structural schematic view of the connection portion of a mouthpiece device and an electronic cigarette body in one of the preferable embodiments of the present application.

The specific structure of an elastic assembly 20 and a moving part 25 of the electronic cigarette is described in detail with the combination of the implementation shown in FIG. 4 as following.

As shown in FIG. 4, the elastic assembly 20 mainly comprises a sealing plug 21, a first sealing element 22, a first elastic assembly 23 and a second elastic assembly 24. In this embodiment, the first elastic assembly 23 is located between the electronic cigarette body 1 and the mouthpiece device 2 and abuts elastically between the first sealing element 22 and the moving part 25, one end of the second elastic assembly 24 is arranged on the first sealing element 22, a limit convex 243 which buckles the mouthpiece device 2 when in a non-stretched state is arranged on the other end of the second elastic assembly 24 (combining with the illustration of FIG. 7).

Figure 5:
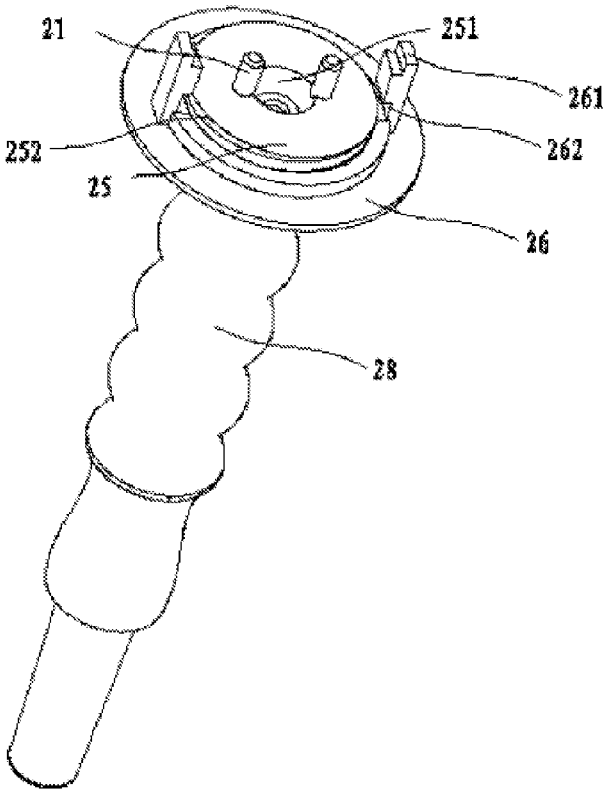
FIG. 5 is a structural schematic view of a mouthpiece tube, a fixed cover, a moving part and a sealing plug of the mouthpiece device in FIG. 1.

The moving part 25 is roughly disc-shaped structure, it is mainly used for transmitting force, the moving part 25 is detachably connected at one end of a mouthpiece tube 28. As shown in FIG. 5, a second smoke channel 251 in communication both with the first smoke channel 11 and the mouthpiece tube 28 is arranged on the moving part 25. When the first smoke channel 11 is in communication with the second smoke channel 251, the smoke produced by the atomizing assembly 12 flows out from the first smoke channel 11, and flows into the mouthpiece tube 28 through the second smoke channel 251, and is inhaled by user.

In this embodiment, a connecting tube (not labeled in the figure) plug-in connected with the mouthpiece tube 28 is arranged at the extending of one end of the moving part, the moving part 25 is permanently connected with the mouthpiece tube 28 through the connecting tube. A one-way valve 282 is arranged at the junction between the moving part 25 and the mouthpiece tube 28 (as shown in FIG. 4), as the structure and function of the one-way valve 282 is based on the prior art, so it is not explained in detailed.

In addition, a first slope 252 (combining with the illustration of FIG. 5) fitted with the second elastic assembly 24 is defined on the end face lateral margin of the side opposite to the electronic cigarette body 1 of the moving part 25. The first slope 252 is fitted with the second elastic assembly 24, and playing the role of making the upward movement of the moving part 25 conveniently, the function will be described specifically when introducing the second elastic assembly 24 below.

The sealing plug 21 is roughly cylinder structure, it is mainly used for enabling the first smoke channel 11 and the second smoke channel 251 to be in communication with one another or to be staggered from one another and not in communication. Specifically, as shown in FIG. 4, in this embodiment, the sealing plug is fixed on the moving part 25, and extends at the side next to the electronic cigarette body 1, when the sealing plug 21 is in a butting connection with the first smoke channel 11, the first smoke channel 11 is closed, when the sealing plug 21 is separated from the first smoke channel 11, the first smoke channel 11 is opened. As there are two first smoke channels 11 in this embodiment, so there are also two sealing plugs 21, and the two sealing plugs 21 are fixed on the moving part 25 along the docking way of the first smoke channels 11 respectively.

The first sealing element 22 is mainly playing the role of sealing the tobacco tar, and preventing the tobacco tar flowing out from the first smoke channel 11, and being inhaled after flowing through the second smoke channel 251, thus affecting the taste of user and product satisfaction. As shown in FIG. 4, the first elastic assembly 23 abuts between the first element 22 and the moving part 25, one end of the second elastic assembly 24 is arranged out the first element 22.

Figure 6:
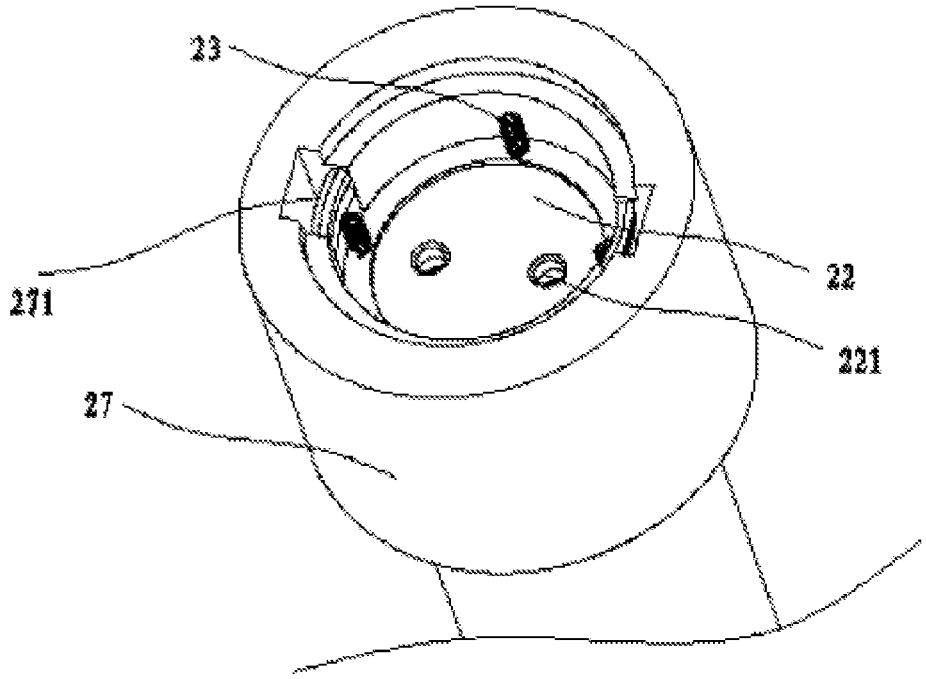
FIG. 6 is a structural schematic view of a mounting base, a first elastic assembly and a first sealing element of the mouthpiece device in FIG. 1.

The first element 22 is located between the moving part 25 and the electronic cigarette body 1, combining with the illustration of FIG. 6, a through hole 221 in communication with the first smoke channel 11 is arranged on it, the through hole 221 is fitted with the sealing plug 21, the sealing plug 21 is in a butting connection with the first smoke channel 11 by running through the through hole 221. In this embodiment, there are two through holes 221.

The first elastic assembly 23 is one kind of spring leaves or spring structures, it is mainly used for providing a pushing force upward for the moving part 25, when the first elastic assembly 23 is pressed deformation to produce resilience force, enabling the sealing plug 21 on the moving part 25 to be separated from the first smoke channel 11. Combining with the illustration of FIG. 6, in this embodiment, there are four first elastic assemblies 23, and they are all springs structure, one end of each spring structure abuts the moving part 25, the other end is fixed on the first element 22.

Figure 7:
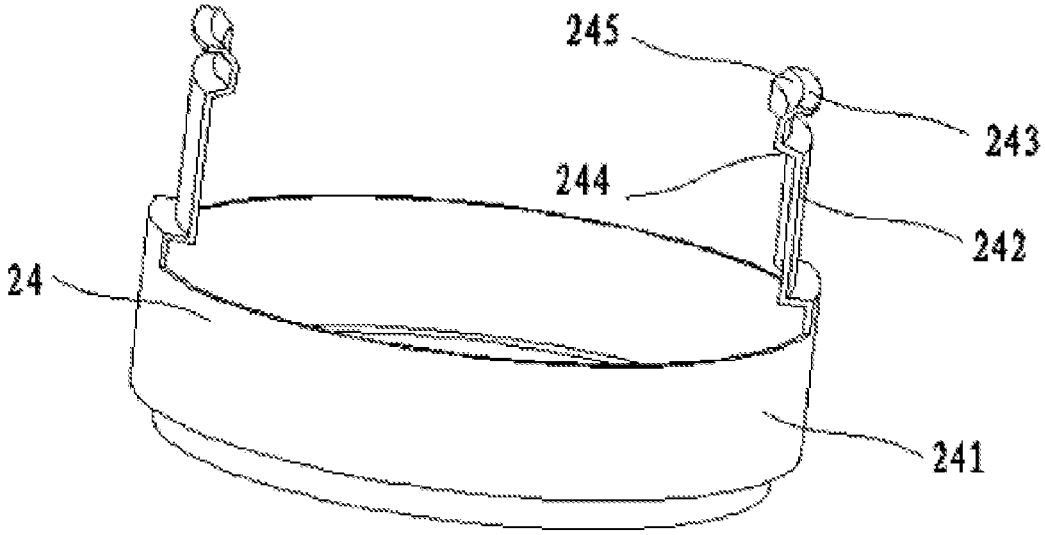
FIG. 7 is a structural schematic view of a second elastic assembly of the mouthpiece device in FIG. 1.

As shown in FIG. 7, the second elastic assembly 24 roughly comprises a connector 242, a limit convex 243 and a fixed part 241. Wherein the fixed part 241 is used for supporting the connector 242, in this embodiment, the fixed connector 241 is cylindrical shape, it is arranged out the first element 22, and abuts the circumferential wall of the first element 22. The connector 242 is elastic piece structure, it abuts the sidewall of the moving part 25, one end of the connector 242 is fixed on the fixed part 241, the other end bends and extends toward the side next to the moving part 25 and forms the limit convex 243, the upper end of the limit convex 243 (the side opposite to the electronic cigarette body 1 of the limit convex 243) has a third slope 245, the bottom (the side next to the electronic cigarette body 1 of the limit convex 243) has a second slope 244 fitted with the first slope 252.

Specifically, when the first smoke channel 11 is closed, at the time, the bottom of the limit convex 243 is abutted the upper end of the moving part 25, and the limit convex 243 is buckled on the moving part 25, the resilience force produced by pressing the first elastic assembly 23 and acting on the moving part 25 is less than the downward acting force acting by the limit convex 243 to the moving part 25, thus the moving part 25 is locked.

When the mouthpiece tube 28 is stretched, the mouthpiece tube 28 drives the moving part 25 moving upward, at the same time the resilience force produced by the press deformation of the first elastic assembly 23 and acting on the moving part 25 can also driving the moving part 25 moving towards the side opposite to the electronic cigarette body 1, thus the first smoke channel 11 is opened.

During the stretching process, the second slope 244 contributes to the moving part 25 to drive the limit convex 243 and produce elastic deformation, and the first slope 252 contributes to the whole driving process; in addition, when the first smoke channel 11 is being closed again, the moving part 25 moves downwards under an external force, the third slope 245 contributes to the downward movement of the moving part 25, thus the limit convex 243 buckles on the moving part 25 again.

In addition, when the first elastic assembly 23 produces elastic deformation under an external force, at the time, the resilience force produced by pressing the first elastic assembly 23 and acting on the moving part 25 is more than the downward acting force acting by the limit convex 243 to the moving part 25, the moving part 25 moves upwards under the resilience force of the first elastic assembly 23, the first smoke channel 11 can also be opened.

Figure 3:
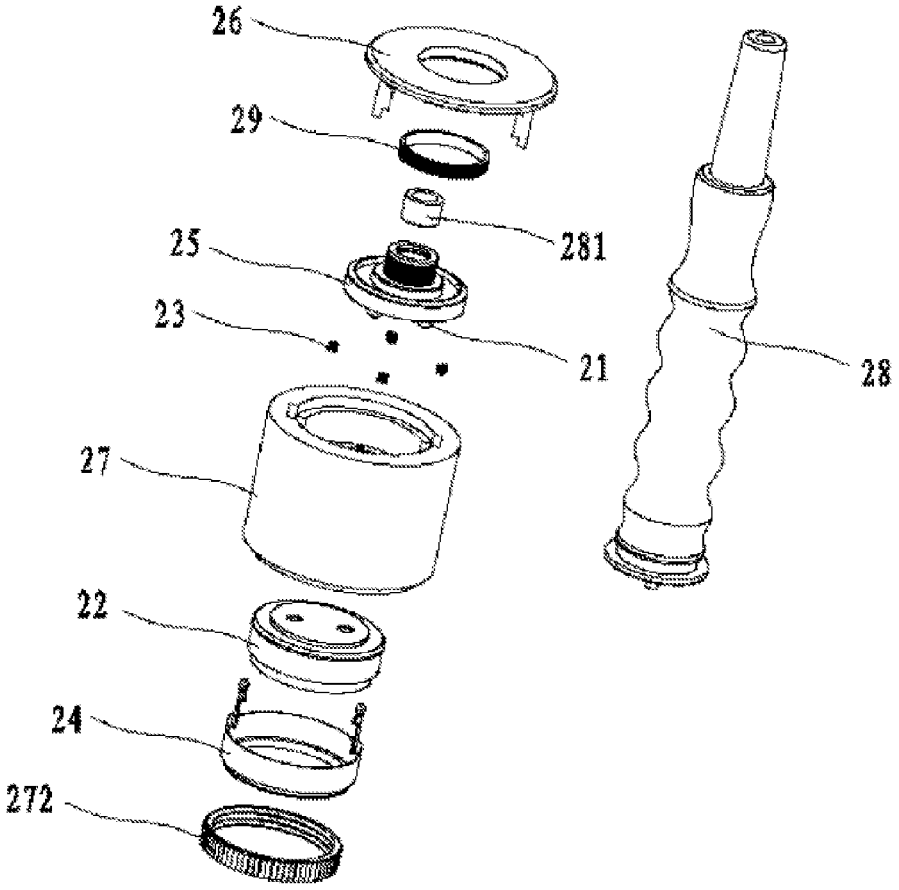
FIG. 3 is an exploded view of the mouthpiece device in FIG. 1.

The specific structure of the mouthpiece device 2 of the electronic cigarette is described in detail with combination of the implementation shown in FIG. 3 as following.

FIG. 3 is an exploded view of a mouthpiece device 2, the mouthpiece device 2 mainly comprises a moving part 25, a fixed cover 26, a mounting base 27 and a mouthpiece tube 28. Wherein a second smoke channel 251 used for discharging the smoke in the first smoke channel 11 is defined in the mouthpiece 28.

Combining with the illustration of FIG. 4, the fixed cover 26 is roughly discal, a through hole (not labeled in the figure) for the mouthpiece tube 28 to mount through is arranged on the fixed cover 26, which makes the fixed cover 26 be movably connected with the mouthpiece tube 28, that is one end of the mouthpiece tube 28 is in a butting connection with the moving part 25 through the fixed cover 26, in order to prevent the tobacco tar leaking from the gap between the mouthpiece tube 28 and the fixed cover 26, a second sealing ring 29 can be arranged at the junction between the mouthpiece tube 28 and the fixed cover 26 (as shown in FIG. 3).

Further, combining with the illustration of FIG. 5, the fixed cover 26 comprises a guide part 261, an accommodation space 262 for the elastic deformation of the second elastic assembly 24 is arranged on the guide part 261. In this embodiment, there are two guide parts 261, one end of each guide part 261 is fixed on the fixed cover 26, the other end is a guide arm extending opposite to the fixed cover 26.

Combining with the illustration of FIG. 6, a guide groove 271 fitting with the guide part 261 is arranged on the mounting base 27, the guide groove 271 and the guide part 261 fit with each other, limit the junction between the fixed cover 26 and the mounting base 27, enabling the location of the accommodation space 262 to correspond with the second elastic assembly 24, thus there is certain extension space during the deformation of the second elastic assembly 24.

In addition, the mounting base 27 is further used for connecting the electronic cigarette body 1, in this embodiment, the mounting base 27 is detachably connected with the electronic cigarette body 1 by the method of thread connection, an internal thread 272 is connected permanently in the mounting base 27 (as shown in FIG. 4), an external thread (not labeled in the figure) fitting with the external sleeve 10 is arranged on the external sleeve 10 of the electronic cigarette body 1.

When assembling, firstly fixing the elastic assembly 20 in the mounting base 27; secondly connecting the mouthpiece tube 28 to the moving part 25 permanently; then defining the fixed cover 26 out the mouthpiece tube 28, and making the fixed cover 26 fixed on the mounting base 27, and the fixed cover 26 is in moving connection with the mouthpiece tube 28; finally connecting the electronic cigarette body 1 to one end of the mounting base 27.

Specifically, in this embodiment, the assembling process of the elastic assembly 20 comprises, firstly connecting the fixed part 241 of the second elastic assembly 24 to the circumferential wall of the first element 22, enabling the second elastic assembly 24 to be arranged on the first element 22; secondly fixing the first elastic assembly 23 on the end of the first element 22 towards the moving part 25; finally fixing the sealing plug 21 on the moving part 25, and extending towards the side next to the electronic cigarette body 1, at the same time the moving part 25 abuts elastically the first elastic assembly 23.

During the process of using, firstly connecting the electronic cigarette body 1 to the mouthpiece device 2 permanently, enabling the elastic assembly 20 in the mouthpiece device 2 to close the first smoke channel 11 of the electronic cigarette body 1; at this time, the sealing plug 21 is in butting connection with the first smoke channel 11 through the through hole 221 on the first element 22, enabling the sealing plug 21 to close the first smoke channel 11.

In addition, when need to smoke, pull the mouthpiece tube 28, the moving part 25 moves upwards under the force, the resilience force of the first elastic assembly 23 by pressing can also drive the moving part 25 to move towards the side opposite to the electronic cigarette 1, to open the first smoke channel 11.

Secondly, when need to smoke, the first smoke channel 11 can also be opened by a hard press on the mouthpiece tube 28. Specifically, the moving part 25 moves downward under the force, and presses the first elastic assembly 23, enables the first elastic assembly 23 to produce elastic deformation; after stopping pressing the mouthpiece tube 28, the resilience force produced by the first elastic assembly 23 is enough to push the moving part 25 to move upward, and drives the sealing plug 21 on the moving part 25 to separate from the first smoke channel 11, thus the first smoke channel 11 is opened.

Specifically, before pressing hard on the mouthpiece tube 28 (that is when the first smoke channel 11 is in closed state), the limit convex 243 of the second elastic assembly 24 buckles on the moving part 25, that is the second slope 244 of the limit convex 243 abuts the first slope 252 of the moving part 25, thus the moving part 25 is locked.

After stopping pressing the mouthpiece tube 28, the first slope 252 pushes the second elastic assembly 24 to produce elastic deformation, making the limit convex 243 extend into the accommodation space 262 on the fixed cover 26.

Finally, when stop smoking, pressing the mouthpiece tube 28 lightly, the moving part 25 moves downward, and drives the sealing plug 21 to be in butting connection with the first smoke channel 11, that is the first smoke channel 11 and the second smoke channel 251 are staggered from one to another, thus the first smoke channel 11 is closed again; at this time the bottom of the limit convex 243 of the second elastic assembly 24 abuts the upper end of the moving part 25.

Specifically, during the process of pressing the mouthpiece tube 28, the moving part 25 moves downward under the force, when the second slope 244 on the bottom of the limit convex 243 abuts the first slope 252 of the moving part 25, the moving part 25 buckles on the moving part 25 again, making the sealing plug 21 be in butting connection in the first smoke channel 11 steadily.

Figure 8:
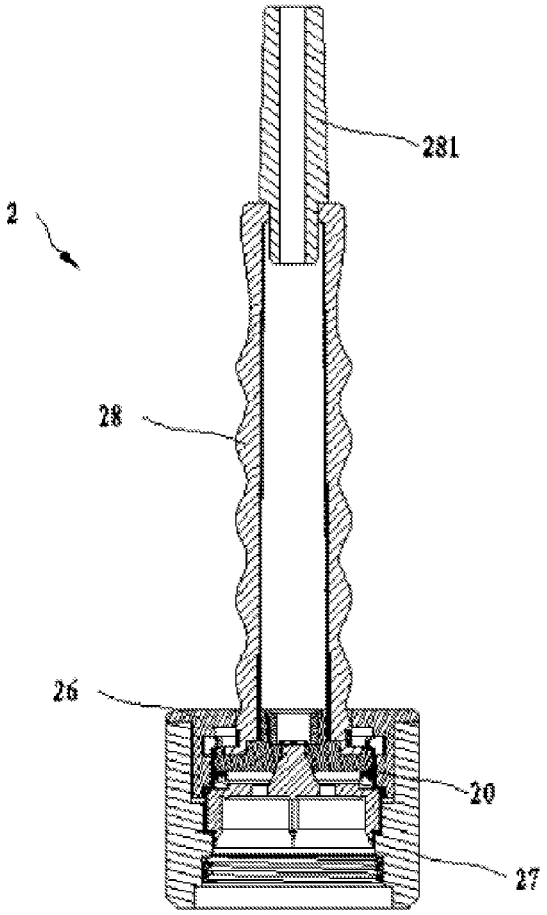
FIG. 8 is a structural schematic view of a mouthpiece device of an electronic cigarette in a second preferable embodiment of the present application.
Figure 11:
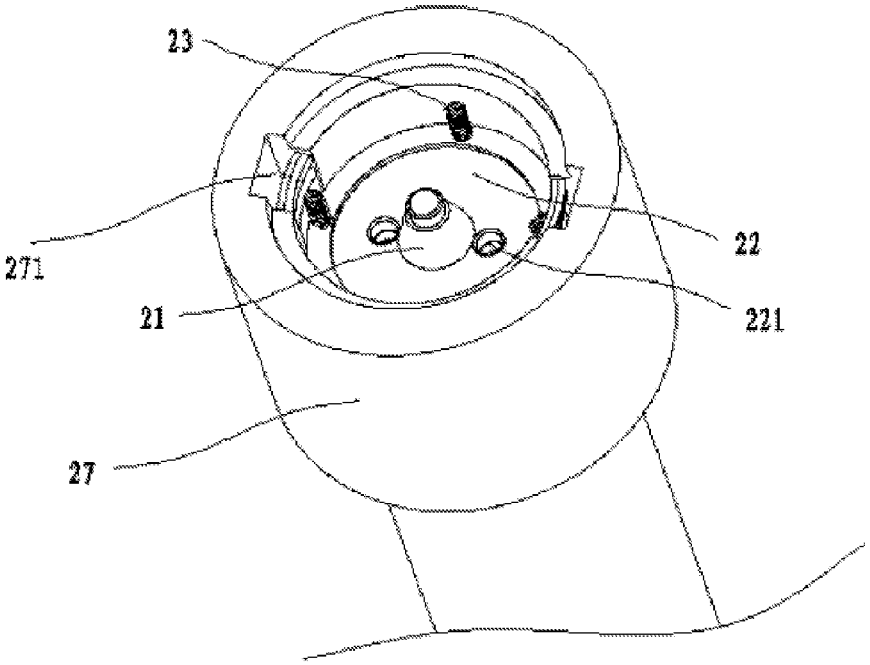
FIG. 11 is a structural schematic view of a mounting base, a first elastic assembly, a sealing plug and a first sealing element in FIG. 1.

As shown in FIG. 8, a structural schematic view of an electronic cigarette in a second preferable embodiment of the present application, the different from the first embodiment is the fixed location of the sealing plug 21, in this embodiment, the sealing plug 21 is fixed on the first element 22 (as shown in FIG. 11), and in butting connection with the second smoke channel 251 on the moving part 25, thus the second smoke channel 251 is closed.

Figure 9:
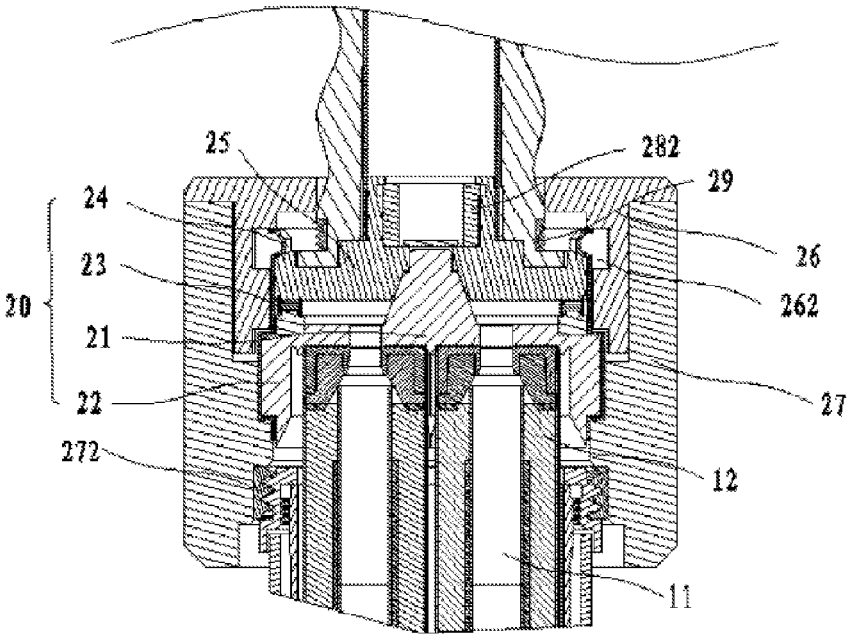
FIG. 9 is a structural schematic view of the connection portion of a mouthpiece device and an electronic cigarette body in a second preferable embodiment of the present application.
Figure 10:
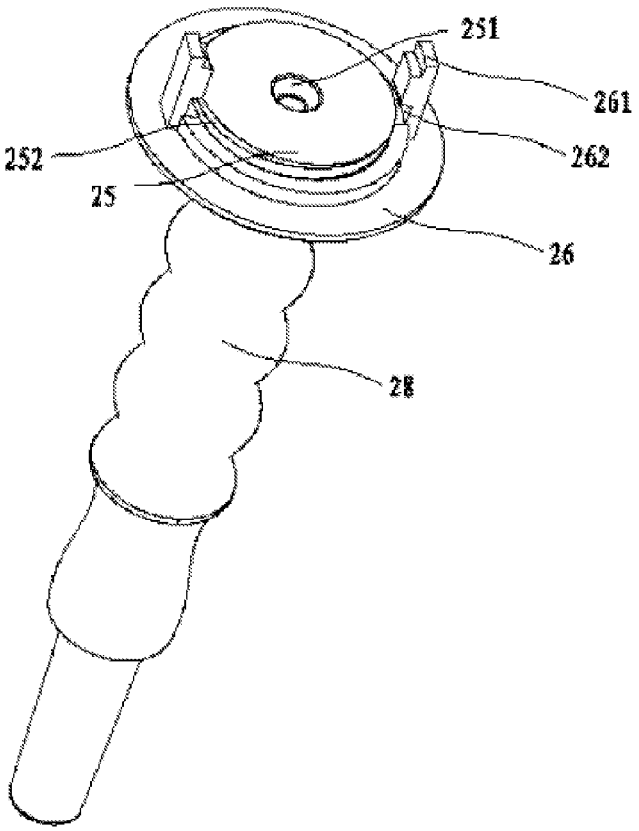
FIG. 10 is a structural schematic view of a mouthpiece tube, a fixed cover and a moving part of the mouthpiece device in FIG. 1.

FIG. 9 is a structural schematic view of the junction of a mouthpiece device 2 and an electronic cigarette body 1, specifically, the first element 22 is located between the moving part 25 and the electronic cigarette body 1, the sealing plug 21 is fixed on the first element 22, and extending towards the side opposite to the electronic cigarette body 1. When the sealing plug 21 is in docking connection with the second smoke channel 251, the second smoke channel 251 is closed, when the sealing plug 21 is separated from the second smoke channel 251, the second smoke channel 251 is opened. In this embodiment, the sealing plug 21 is roughly cylindrical, and mainly used for opening or closing the second smoke channel 251; as there are only one second smoke channel 251, so the number of the sealing plug is also one, and the sealing plug 21 is fixed on the first sealing element 22 along the clamping way of the second smoke channel 251.

Specifically, in this embodiment, the assembling process of the elastic assembly 20 comprises, firstly connecting the fixed part 241 of the second elastic assembly 24 to the circumferential wall of the first element 22, enabling the second elastic assembly 24 to be arranged on the first element 22; secondly fixing the first elastic assembly 23 on the end towards the moving part 25 of the first element 22; finally fixing the sealing plug 21 on the first element 22, and extending towards the side opposite to the electronic cigarette body 1, at the same time the moving part 25 abuts elastically the first elastic assembly 23.

An assembly method of electronic cigarette is further provided by present invention, comprising following steps:

S1, providing a mounting base 27, fixing an elastic assembly 20 in the mounting base 27;

Specifically, the assembling process of the elastic assembly 20 comprises, firstly connecting the fixed part 241 of the second elastic assembly 24 to the circumferential wall of the first element 22, enabling the second elastic assembly 24 to be arranged on the first element 22; secondly fixing the first elastic assembly 23 on the end towards the moving part 25 of the first element 22; finally fixing the sealing plug 21 on the moving part 25, and extending towards the side next to the electronic cigarette body 1, at the same time the moving part 25 abuts elastically the first elastic assembly 23.

S2, providing a mouthpiece tube 28, a moving part 25 and a fixed cover 26, connecting the mouthpiece tube 28 to the moving part 25 permanently, defining the fixed cover 26 out of the mouthpiece tube 28, and fixing the fixed cover 26 on the mounting base 27; wherein the fixed cover 26 is in movable connection with the mouthpiece tube 28.

S3, providing an electronic cigarette body 1, connecting the electronic cigarette body 1 to an end of the mounting base 27. The electronic cigarette body 1 is fixed on one end of the mounting base 27 by thread connection.

To sum up, by setting an elastic assembly connected to the electronic cigarette body in the mouthpiece device in present invention, the elastic assembly is used for provide an elastic force to the mouthpiece device for being away from the electronic cigarette body when in a stretched state and to limit the position of the mouthpiece device when in a non-stretched state, so as to enable the first smoke channel and the second smoke channel to be in communication with one another or to be staggered from one another and not in communication, to make the elastic assembly have the function of the switch, effectively avoid the children mistake inhalation of the electronic cigarette, and the operation of the electronic cigarette in present invention is simple and convenient, selectivity is good, and assembly is easy; and the electronic cigarette has certain enjoyment, can bring the pleasure of smoking.

Understandably, in the inspiration of the present application, those ordinary skills in the art can also make many modifications without breaking away from the subject of the present application and the protection scope of the claims. All these modifications belong to the protection of the present application.

What is claimed is:

1. An electronic cigarette, comprising an electronic cigarette body (1) and a mouthpiece device (2) connected at one end of the electronic cigarette body (1), wherein the electronic cigarette body (1) is provided with at least one first smoke channel (11), the mouthpiece device (2) is provided with a second smoke channel (251) configured to discharge smoke of the first smoke channel (11); wherein the mouthpiece device (2) is in a sliding butting connection with the electronic cigarette body (1), a junction between the mouthpiece device (2) and the electronic cigarette body (1) is provided with an elastic assembly (20), the elastic assembly (20) is configured to enable the first smoke channel (11) and the second smoke channel (251) to be in communication with one another or to be staggered from one another and not in communications;

wherein the elastic assembly (20) comprises a first elastic assembly (23) and a second elastic assembly (24); the first elastic assembly (23) is between the electronic cigarette body (1) and the mouthpiece device (2), and the first elastic assembly (23) provides an elastic force to the electronic cigarette body (1) and the mouthpiece device (2) respectively; one end of the second elastic assembly (24) is connected permanently with the electronic cigarette body (1), a limit convex (243) which buckles the mouthpiece device (2) when in the non-stretched state is arranged on the other end of the second elastic assembly (24).

2. The electronic cigarette according to claim 1, wherein the mouthpiece device (2) comprises a mouthpiece tube (28), and a moving part (25) detachably connected at one end of the mouthpiece tube (28); the limit convex (243) buckles the moving part (25) when in the non-stretched state.

3. The electronic cigarette according to claim 1, wherein the first elastic assembly (23) is one kind of spring leaves or spring structures.

4. The electronic cigarette according to claim 1, wherein the second elastic assembly (24) comprises a fixed part (241) connected permanently with the electronic cigarette body (1), a connector (242) that one end is connected with the fixed part (241) and extends towards the side opposite to the electronic cigarette body (1), and the limit convex (243) connected with the other end of the connector (242).

5. An assembly method of electronic cigarette of claim 1, wherein the method comprises following steps:

S1, providing a mounting base (27), fixing an elastic assembly (20) in the mounting base (27);

S2, providing a mouthpiece tube (28), a moving part (25) and a fixed cover (26), connecting the mouthpiece tube (28) to the moving part (25) permanently, sheathing the fixed cover (26) outside the mouthpiece tube (28), and fixing the fixed cover (26) on the mounting base (27);

S3, providing an electronic cigarette body (1), connecting the electronic cigarette body (1) to an end of the mounting base (27).

6. The electronic cigarette according to claim 2, wherein the second smoke channel (251) is arranged along the moving part (25) axially and in communication with the mouthpiece tube (28).

7. The electronic cigarette according to claim 2, wherein a first slope (252) fitting for the limit convex (243) is arranged on a lateral edge of an end of the moving part (25), the end is opposite to the electronic cigarette body (1); a second slope (244) which adapts with the first slope (252) is arranged on an end of the limit convex (243), the end is near the electronic cigarette body (1); a third slope (245) is arranged on the end opposite to the electronic cigarette body (1).

8. The electronic cigarette according to claim 2, wherein the elastic assembly (20) comprises a first sealing element (22) connected permanently with the electronic cigarette body (1), and a sealing plug (21) configured for enabling the first smoke channel (11) and the second smoke channel (251) to be in communication with one another or to be staggered from one another and not in communication when in a non-stretched state.

9. The electronic cigarette according to claim 8, wherein at least one through hole (221) in communication with each the first smoke channel (11) is arranged on the first sealing element (22); the first elastic assembly (23) abuts elastically between the first sealing element (22) and the moving part (25), one end of the second elastic assembly (24) is arranged out the first sealing element (22).

10. The electronic cigarette according to claim 8, wherein the sealing plug (21) is connected permanently with the moving part (25), and extends towards a side near the electronic cigarette body (1), the sealing plug (21) is configured for plug-in connecting with the first smoke channel (11) when in a non-stretched state.

11. The electronic cigarette according to claim 8, wherein the sealing plug (21) is connected permanently with the first sealing element (22), and extends towards the side opposite to the electronic cigarette body (1), the sealing plug (21) is configured for plug-in connecting with the second smoke channel (251) when in the non-stretched state.

12. The electronic cigarette according to claim 2, wherein the mouthpiece device (2) further comprises a mounting base (27) detachably connected with the electronic cigarette body (1), and a fixed cover (26) fixed on the mounting base (27).

13. The electronic cigarette according to claim 12, wherein the fixed cover (26) comprises a guide part (261), one end of the guide part (261) is fixed on the fixed cover (26), the other end of the guide part (261) extends towards a side opposite to the fixed cover (26); an accommodation space (262) for elastic deformation of the second elastic assembly (24) is arranged on the guide part (261).

14. The electronic cigarette according to claim 13, wherein a guide groove (271) fitting with the guide part (261) is arranged on the mounting base (27).

15. The electronic cigarette according to claim 12, wherein an internal thread (272) configured for detachably connecting with the electronic cigarette body (1) is arranged in the mounting base (27).

16. An electronic cigarette, comprising an electronic cigarette body (1) and a mouthpiece device (2) connected at one end of the electronic cigarette body (1); wherein the electronic cigarette body (1) is provided with at least one first smoke channel (11), the mouthpiece device (2) is provided with a second smoke channel (251) configured to discharge smoke of the first smoke channel (11); wherein the mouthpiece device (2) is in a sliding docking connection with the electronic cigarette body (1), a junction between the mouthpiece device (2) and the electronic cigarette body (1) is provided with an elastic assembly (20); the elastic assembly (20) is configured to enable the first smoke channel (11) and the second smoke channel (251) to be in communication with one another or to be staggered from one another and not in communication;

wherein the mouthpiece device (2) comprises a mouthpiece tube (28), and a moving part (25) detachably connected with one end of the mouthpiece tube (28);

wherein the elastic assembly (20) comprises a first elastic assembly (23), a second elastic assembly (24) and a sealing plug (21); the first elastic assembly (23) abuts elastically between the electronic cigarette body (1) and the moving part (25), one end of the second elastic assembly (24) is connected permanently with the electronic cigarette body (1), a limit convex (243) which buckles the mouthpiece device (2) when in a non-stretched state is arranged on the other end of the second elastic assembly (24); the sealing plug (21) is connected permanently with the moving part (25), and extending towards a side near the electronic cigarette body (1), the sealing plug (21) is configured for plug-in connecting with the first smoke channel (11) when in a non-stretched state.

* * * * *